US006287415B1

(12) United States Patent
Salmi et al.

(10) Patent No.: US 6,287,415 B1
(45) Date of Patent: Sep. 11, 2001

(54) ARRANGEMENT IN SODA RECOVERY BOILER FOR REMOVING MELTS FOR MAINTENANCE

(75) Inventors: Kalle Salmi, Tampere; Jaakko Mäkelä, Firkkala; Aki Hakulinen; Tuomo Ruohola, both of Tampere, all of (FI)

(73) Assignee: Kvaerner Pulping Oy, Tampere (FI)

( * ) Notice: Subject to any disclaimer, the term of this patent is extended or adjusted under 35 U.S.C. 154(b) by 0 days.

(21) Appl. No.: 09/652,311

(22) Filed: Aug. 31, 2000

(30) Foreign Application Priority Data

Sep. 10, 1999 (FI) ..... 1999 1933

(51) Int. Cl.[7] ..... D21C 11/12

(52) U.S. Cl. ..... 162/30.1; 162/31; 422/185; 48/197 R

(58) Field of Search ..... 162/30.1, 30.11, 162/31; 422/185; 110/238; 48/197 R

(56) References Cited

U.S. PATENT DOCUMENTS 4,708,324 * 11/1987 Goodspeed ..... 15/46
5,635,095 * 6/1997 Kleinfeld ..... 222/590
5,800,773 * 9/1998 Beveridge et al. ..... 266/236
5,976,319 * 11/1999 Paju et al. ..... 162/30.1

FOREIGN PATENT DOCUMENTS

WO 99/27180 6/1999 (WO) .

* cited by examiner

*Primary Examiner*—Dean T. Nguyen
(74) *Attorney, Agent, or Firm*—Rockey, Milnamow & Katz, Ltd.

(57) ABSTRACT

Arrangement in a soda recovery boiler, comprising normal melt chutes (6) for removing molten salt from the recovery boiler (1). The recovery boiler (1) comprises an outlet (8), mounted in the wall of the recovery boiler such that it is situated lower down than the normal melt chutes (6), in which case the molten salt can be removed from the bottom of the recovery boiler substantially through the outlet (8), when the recovery boiler (1) is emptied for maintenance or the like.

9 Claims, 2 Drawing Sheets

ARRANGEMENT IN SODA RECOVERY BOILER FOR REMOVING MELTS FOR MAINTENANCE

FIELD OF THE INVENTION

The invention relates to an arrangement in a soda recovery boiler, comprising in the lower part of the recovery boiler at least one melt chute for discharging molten salt from the recovery boiler during operation, the chute being provided with a discharge opening connected with the furnace of the recovery boiler.

BACKGROUND OF THE INVENTION

For checking and/or repairing the bottom of a soda recovery boiler, its bottom has to be emptied of the molten salt existing therein. As far as present soda recovery boilers are concerned, this is done by melting a pile of material accumulated at the bottom until the surface of the melt lies on the same level as the normal melt chutes of the soda recovery boiler. After this, plenty of soda melt still remains at the bottom of the recovery boiler, which melt solidifies when it is cooled and must be removed by dissolving it in water or by crushing mechanically. The solution has to be pumped out and the crush has to be moved away from the bottom of the boiler by some method. The diluted solution and the crush leaves the circulation of chemicals and the chemicals are not recovered. This takes time and is difficult and, additionally, causes corrosion at the bottom of the soda recovery boiler. As to the present soda recovery boiler, there is no other practical alternative to empty the bottom of the boiler at the moment. For that reason, a remarkably long time has to be reserved for emptying at a maintenance stop.

SUMMARY OF THE INVENTION

The object of this invention is to provide a solution by which a soda recovery boiler could be emptied in a simpler and easier way and more rapidly than according to the known solutions. The arrangement of the invention is characterized in that the arrangement comprises at least one separate outlet connected with the furnace of the recovery boiler and positioned below the discharge opening of the normal melt chute in the height direction of the recovery boiler in such a way that, for emptying the recovery boiler, the molten salt and/or a washing liquid can be removed through the outlet to a level below the lower edge of the discharge opening of the normal melt chute.

The essential idea of the invention is that a separate outlet is arranged in the recovery boiler, the outlet being situated substantially lower down than the normal discharge openings of the melt chute of the recovery boiler. During normal operation of the soda recovery boiler, such an outlet would be completely closed and would not be opened until for the time of a stop of the recovery boiler, when the bottom of the recovery boiler shall be emptied for checking and/or repair, for instance. The essential idea of a preferred embodiment of the invention is that the outlet is provided with a separate outlet chute through which the molten salt coming from the outlet and the previous washing liquid can be led forward. The essential idea of a second preferred embodiment is that the outlet chute has a structure essentially similar to the structure of the normal melt chutes. In accordance with a third preferred embodiment, the outlet chute is for instance water-cooled and connected to the same cooling system as the other melt chutes. An advantage of the invention is that, by means of a simple and advantageous melt chute, preferably found to be good and functional also in practice and particularly intended for discharge, it is possible to empty the bottom of the recovery boiler as effectively as possible without having to dissolve and pump a cooled and solidified and thick salt layer in a laborious manner. Another advantage of the invention is that such an outlet chute is easy to mount in soda recovery boilers already in use. In addition, the molten salt coming through the outlet chute can easily be led to dissolution and recovery of chemicals.

BRIEF DESCRIPTION OF THE DRAWINGS

The invention will be described in greater detail in the attached drawings, in which

FIG. 1 shows schematically a sectional side view of a soda recovery boiler 1, comprising a furnace 2, into which black liquor is fed through liquor nozzles 3 in a manner known per se. Further, the recovery boiler comprises air feed nozzles 4 positioned on several different levels for feeding air in steps in a way known per se. In the lower part of the recovery boiler, drops of black liquor cause a formation of a pile 5 of salt, which melts and produces molten salt at the bottom of the recovery boiler during operation. Molten salt is removed from the soda recovery boiler 1 through melt chutes 6, whereby the molten salt is led into dissolvers 7, where it dissolves e.g. in thin white liquor and produces green liquor. All this is generally known per se in the art, and therefore, the process or the devices associated with it need not be described any further in this connection.

Figure 1:
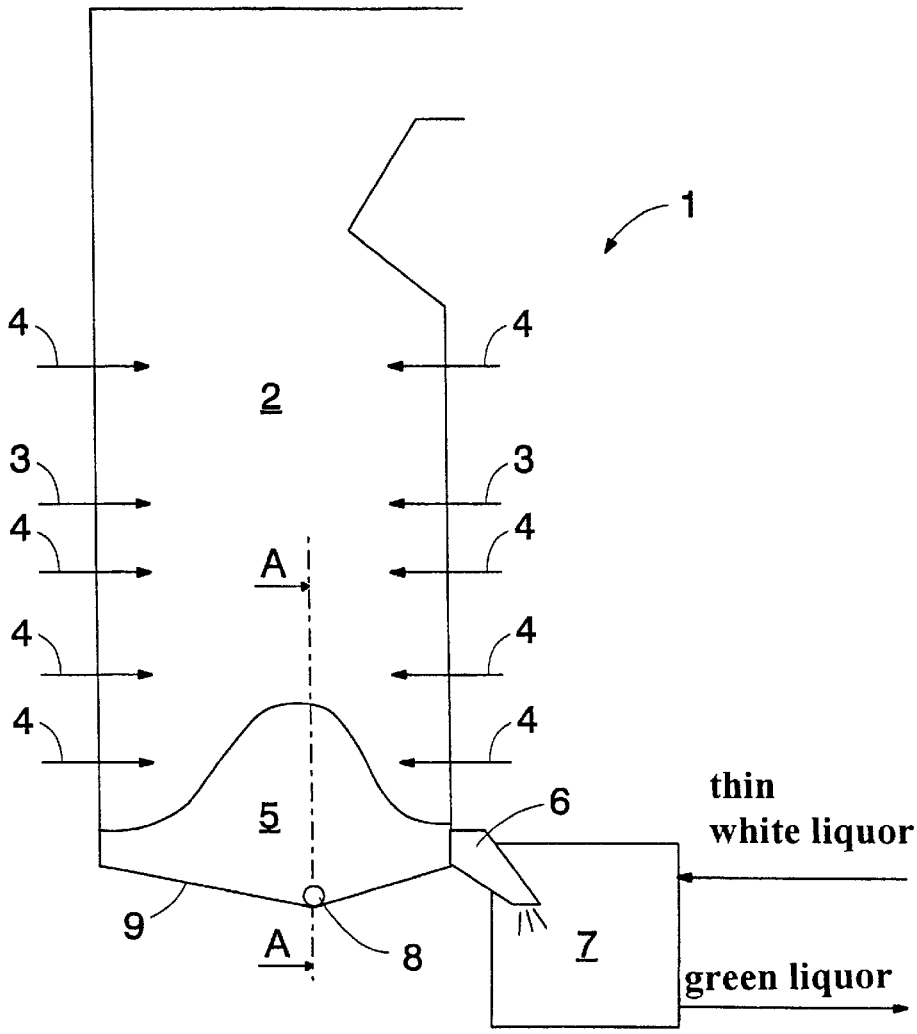
FIG. 1 shows a sectional side view of a typical soda recovery boiler schematically.

When the soda recovery boiler is driven down for maintenance or the like, the lower part of the furnace is kept hot by burners, until the molten salt has been run through the normal melt chutes 6 into a dissolver 7. In order that the molten salt below the normal melt chutes 6 may be removed, the recovery boiler is provided in a manner according to the invention with at least one extra outlet 8 at the place where the bottom 9 of the recovery boiler is lowest down. The outlet 8 is preferably provided with an outlet chute 8*a,* through which the molten salt and the washing liquid possibly needed for dissolving the salt can be led from the outlet forward in a desired manner. The outlet can be situated in any wall or at the bottom, also at the junctions of the walls and the bottom. The bottom of the soda recovery boiler shown in FIG. 1 is a so-called decanting one, the bottom sloping down from the sides towards the middle, so that the lowest point of the bottom 9 will be at the line A—A in this case. According to an embodiment of the invention, the outlet is positioned on one side or on both opposite sides just at this place, so that the soda recovery boiler can be emptied of the molten salt through the outlet chute as well as possible.

Figure 2:
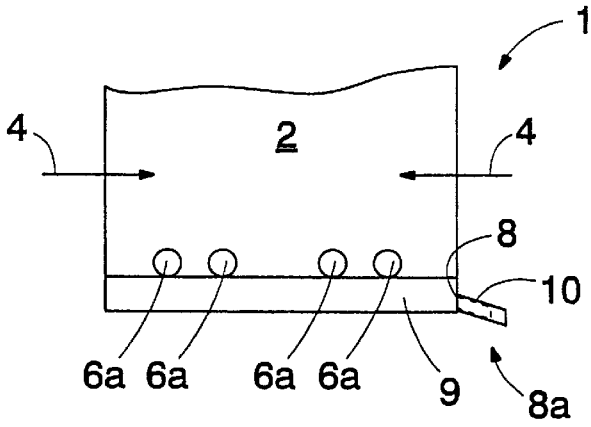
FIG. 2 shows the lower part of the soda recovery boiler schematically in section along the line A—A indicated in FIG. 1, and FIGS. 3*a* and 3*b* show an embodiment of the bottom of a soda recovery boiler suitable for the implementation of the invention, schematically in section in the longitudinal and lateral direction.

FIG. 2 shows the lower part of the soda recovery boiler of FIG. 1 schematically in partial section along line A—A. As appears from the figure, the outlet 8 is situated essentially at the lowest point of the bottom 9 of the recovery boiler. Correspondingly, the figure shows part of the discharge openings 6*a* of the normal melt chutes 6 in the walls of the boiler, whereby it can be seen clearly that the outlet 8 is situated substantially lower down than the discharge openings 6*a* of the normal melt chutes.

DETAILED DESCRIPTION OF THE INVENTION

The molten salt coming from the outlet chute 8*a* is led either directly into a dissolver or for instance into an auxiliary dissolver not shown. In both cases, it dissolves in thin white liquor and produces green liquor. The green liquor produced in the auxiliary dissolver is most preferably led into the normal dissolver to be mixed with the normal liquor inventory.

The outlet chute 8*a* in accordance with the invention may have various structures. Most preferably, the outlet chute 8*a* is a water-cooled melt chute of the same type as the normal melt chutes 6. It can also be uncooled, made of a ceramic material or of heat-resisting steel. During normal operation of the soda recovery boiler 1, the outlet 8 and/or the outlet chute 8*a* are kept closed by means of a plug made of a mass or some other suitable material. The essential thing is that the plug must remain closed and prevent molten salt from running out during normal operation, but it must be relatively easy to open for emptying the recovery boiler 1. FIG. 2 shows schematically by a broken line the plug 10, positioned in the outlet 8 of the outlet chute at the end of a maintenance stop in order to close the outlet chute to a flow of molten salt during normal operation.

Figure 3A:
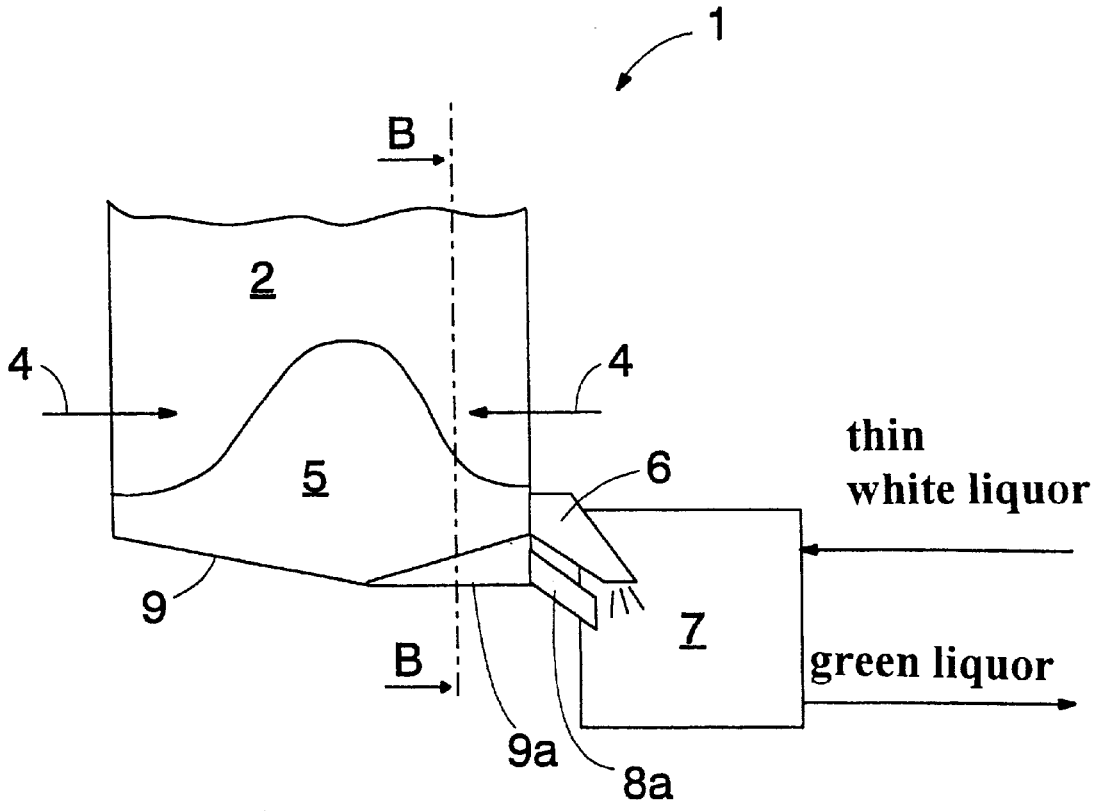
Figure 3B:
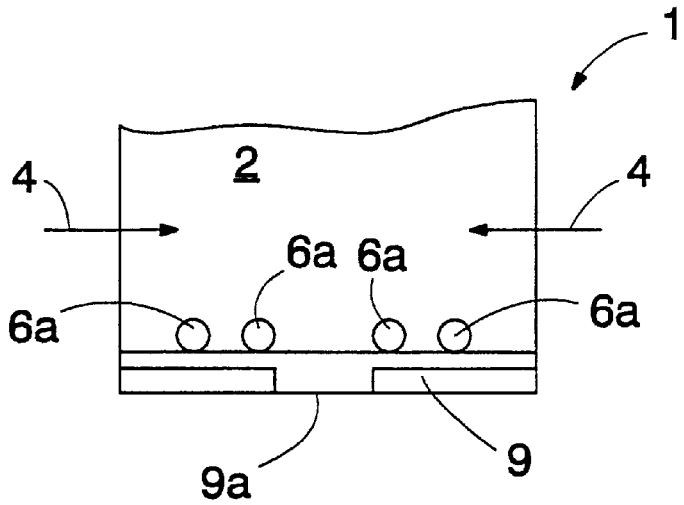

FIGS. 3*a* and 3*b* show schematically the bottom of a soda recovery boiler suitable for the implementation of the invention in section in longitudinal and lateral section, respectively. FIG. 3*a* shows a bottom part of the soda recovery boiler in section and from a direction corresponding to FIG. 1. As appears from the figure, the bottom 9 is in this embodiment provided with a separate bottom part 9*a* extending lower down than the rest of the bottom, this part forming a chute-like part appearing more clearly from FIG. 3*b*. In this case, the outlet 8 is arranged at the chute-like bottom part 9*a,* the molten salt and the washing liquid used for dissolving the salt running along the bottom first into the chute-like bottom part 9*a* and then out through the outlet 8. Correspondingly, FIG. 3*b* shows, as FIG. 2, the bottom of the soda recovery boiler of FIG. 3*a* in section along the line B—B indicated in FIG. 3*a*. This figure shows clearly how the chute-like bottom part 9*a* has been created in this case for example in the middle of the bottom 9. It can, however, be positioned either symmetrically or asymmetrically with respect to the bottom in an appropriate manner for the embodiment. Such a chute-like or trough-like part can be formed also at bottoms of other kinds than those illustrated in FIGS. 3*a* and 3*b*. Thus, a bottom sloping entirely in the same direction or being horizontal can be provided with such a bottom part forming a chute or a trough lower down than the rest of the bottom level. In this embodiment, the outlet 8 is easy to form in the chute-like or trough-like part even below the bottom of the soda recovery boiler, still preferably at the upwards rising edge of the upper trough of the chute.

By means of the outlet of the invention, the bottom of a soda recovery boiler can be cleaned considerably faster and the time of stoppage can be shortened. This leads to that the bottom is easy to clean and to check more extensively, which increases the working reliability and the safety of the soda recovery boiler. Further, when the outlet once has been made, no additional costs arise from using it. In addition, because the time spent on washing the boiler bottom to remove the salt from the surface of bottom pipes shortens essentially, the result is that the corrosion of the boiler bottom also decreases and, through that, the service life of the boiler increases considerably.

The invention has been described above in the specification and the drawings only by way of example and it is in no way restricted thereto. In boilers having an even bottom, the outlet is positioned at least on the same level as the bottom surface or below it. In decanting boilers, in turn, the outlet is positioned preferably at the lowest place of the bottom. Essential is also that the outlet is only meant for emptying the boiler and is kept closed during normal operation, the molten salt being discharged through the normal melt chutes in order to be dissolved.

What is claimed is:

1. Arrangement in a soda recovery boiler having a furnace, comprising in the lower part of the recovery boiler at least one normal melt chute for discharging molten salt from the recovery boiler during operation, the normal melt chute being provided with a discharge opening connected with the furnace of the recovery boiler, wherein the arrangement comprises at least one separate outlet connected with the furnace of the recovery boiler and positioned below the discharge opening of the normal melt chute in the height direction of the recovery boiler in such a way that, for emptying the recovery boiler, the molten salt and/or a washing liquid can be removed through the outlet to a level below the lower edge of the discharge opening of the normal melt chute.

2. Arrangement according to claim 1, wherein the recovery boiler has a wall and a bottom and said separate outlet is formed in the soda recovery boiler in such a way that the outlet is situated in the wall of the recovery boiler, at the lowest point of the bottom of the recovery boiler.

3. Arrangement according to claim 2, further comprising a separate melt chute which is mounted in connection with the separate outlet.

4. Arrangement according to claim 3, wherein the outlet chute is water-cooled.

5. Arrangement according to claim 3, wherein the outlet chute is made of a ceramic material.

6. Arrangement according to claim 3, wherein the outlet chute is made of a heat-resistant steel material.

7. Arrangement according to claim 1, further comprising a plug closing the outlet during normal operation of the recovery boiler, which plug can be removed from outside of the recovery boiler for emptying the recovery boiler.

8. Arrangement according to claim 1, wherein the soda recovery boiler has a bottom sloping down from two opposite sides towards the middle of the recovery boiler so as to form an angle at the lowest point of the bottom, the outlet being substantially at said angle.

9. Arrangement according to claim 1, wherein the soda recovery boiler has a wall and a bottom provided with a chute-like bottom part which extends lower down than the rest of the bottom and the outlet is positioned in the wall of the recovery boiler at said chute-like bottom part.

* * * * *